US006935150B2

(12) United States Patent
Merle et al.

(10) Patent No.: US 6,935,150 B2
(45) Date of Patent: Aug. 30, 2005

(54) SUPERPLASTICITY FORMING MOULD AND MOULD INSERT

(75) Inventors: Daniel Merle, Colleret (FR); Frédéric Caillaud, Maubeuge (FR)

(73) Assignee: Vesuvius Crucible Company, Wilmington, DE (US)

( * ) Notice: Subject to any disclaimer, the term of this patent is extended or adjusted under 35 U.S.C. 154(b) by 146 days.

(21) Appl. No.: 10/380,487

(22) PCT Filed: Sep. 12, 2001

(86) PCT No.: PCT/BE01/00151

§ 371 (c)(1),
(2), (4) Date: Mar. 12, 2003

(87) PCT Pub. No.: WO02/22286

PCT Pub. Date: Mar. 21, 2002

(65) Prior Publication Data

US 2004/0007044 A1 Jan. 15, 2004

(30) Foreign Application Priority Data

Sep. 15, 2000 (EP) ..... 00870205

(51) Int. Cl.[7] ..... B21D 26/02; B21D 37/16
(52) U.S. Cl. ..... 72/60; 72/63; 72/342.94
(58) Field of Search ..... 72/60, 61, 63, 72/446, 448, 481.1, 455, 342.94; 100/301, 315

(56) References Cited

U.S. PATENT DOCUMENTS

| | | | | |
|---|---|---|---|---|
| 5,214,949 A | | 6/1993 | Cadwell | |
| 5,571,436 A | | 11/1996 | Gregg et al. | |
| 5,638,724 A | * | 6/1997 | Sanders | 72/60 |
| 5,661,992 A | | 9/1997 | Sanders | |
| 5,728,309 A | * | 3/1998 | Matsen et al. | 72/60 |
| 6,553,804 B2 | * | 4/2003 | Convert | 72/60 |
| 6,613,164 B2 | * | 9/2003 | Dykstra | 72/62 |

* cited by examiner

*Primary Examiner*—David Jones
(74) *Attorney, Agent, or Firm*—Robert S. Klemz, Jr.; Donald M. Satina; James R. Williams

(57) ABSTRACT

The mould (10) includes at least one part (20), intended to be in contact with the component (12) being moulded, made from sintered vitreous silica. According to the process, said component (12) is formed by the superplastic forming in the mould (10) of a plate (18) made of a material capable of undergoing superplastic deformation, for example titanium or titanium alloy, aluminium or aluminium alloy, or any material exhibiting superplastic properties. Preferably, a barrier is formed between at least a part of the contact surfaces of the mould (10) and the component (12) being moulded, for example by coating with boron nitride, at least partially, the contact surfaces of the mould (10) and the component (12) being moulded, before placing the plate (18) in the mould (10), and/or by injecting an inert gas, notably helium or argon, between the contact surfaces of the mould (10) and the component (12) being moulded.

8 Claims, 2 Drawing Sheets

SUPERPLASTICITY FORMING MOULD AND MOULD INSERT

FIELD OF THE INVENTION

The present invention relates to a mould, an insert, a device and a process for the shaping of a component by superplastic forming, and to a component obtained by this process.

BACKGROUND OF THE INVENTION

Under certain conditions of temperature and mechanical stresses, certain materials such as titanium, titanium alloys, aluminium or certain of its alloys, certain steels, etc., exhibit superplasticity, i.e. the capacity to undergo a large amount of deformation without rupture. This property makes it possible to manufacture components of complex shape by a process of superplastic moulding commonly referred to by the acronym SPF (SuperPlastic Forming).

Metal moulds are already known in the current state of the art for the shaping of components by superplastic forming. Such metal moulds are relatively costly as they are fabricated in special alloys and require complex machining operations. Furthermore, the metal moulds consume a large quantity of energy for heating to a temperature suitable for thermoplastic moulding and are sensitive to uneven temperature distribution and to temperature variations which can lead to deformation of the moulds.

In order to remedy these drawbacks as far as possible, a mould has been proposed in the current state of the art, notably in U.S. Pat. No. 4,984,348, U.S. Pat. No. 5,661,992 or U.S. Pat. No. 5,214,949, for the shaping of a component in titanium or titanium alloy by superplastic forming. The mould normally comprises a base in which a moulding cavity is formed, and a cover, between which a titanium or titanium alloy plate is designed to be placed. In accordance with a conventional process, the mould is heated, the plate is clamped between the base and the cover, then an inert gas is injected under pressure between the cover and plate. Under the effect of the gas pressure, the plate undergoes superplastic deformation and assumes the shape of the mould cavity.

U.S. Pat. No. 4,984,348, U.S. Pat. No. 5,661,992 and U.S. Pat. No. 5,214,949 describe moulds fabricated at least partially in ceramic. This material is more particularly a refractory concrete generally consisting of a filler based on granular vitreous silica and a binder based on aluminate or silicate.

In a refractory concrete, the binder forms a matrix within which the granular filler is held. However, under certain conditions, the grains of the granular filler are capable of being separated from the matrix. In particular, a material such as titanium or a titanium alloy brought to a superplastic state in a refractory concrete mould enters the microcavities in the surface of the mould in contact with the material being moulded. Upon demoulding of the formed items, this leads to separation of material at the surface of the mould and/or to defects at the surface of the formed items. In addition, the mould suffers premature wear. These drawbacks result in numerous moulded components being rejected.

Furthermore, under conditions of superplastic moulding, the materials forming the binder of the refractory concrete of which the mould is made, such as aluminates or silicates, tend to migrate into the moulded component to a depth that may reach several microns. Such surface contamination of the moulded component is not acceptable in certain applications, notably in the case of moulded components in titanium or titanium alloy intended for use in the aircraft industry.

SUMMARY OF THE INVENTION

The purpose of the invention is to propose a mould for the shaping of a component by superplastic forming resistant to wear and thermal shocks capable of producing a component presenting a highly satisfactory surface finish.

To this end, the object of the invention is a mould for the shaping of a component by superplastic forming, notably a component made of titanium or titanium alloy, aluminium or aluminium alloy, or of any material exhibiting superplastic properties, characterised in that it includes at least one part, designed to be in contact with the component to be moulded, made from sintered vitreous silica.

According to other characteristics of this mould:

- the part of the mould in sintered vitreous silica constitutes a mould insert; the mould includes means designed to form a barrier between at least a part of the contact surfaces of the mould and the component being moulded;
- the means designed to form a barrier include a coating of boron nitride covering at least partially the surface of the part of the mould in contact with the component being moulded; and
- the means designed to form a barrier include means of injection of an inert gas, notably helium or argon, at the surface of the mould in contact with the component being moulded.

The object of the invention is also an insert for a mould for the shaping of a component by superplastic forming, notably a component in titanium or titanium alloy, in aluminium or aluminium alloy, or in any material exhibiting superplastic properties, the insert being of the type delineating a moulding surface designed to be in contact with the component being moulded, characterised in that it is made from sintered vitreous silica.

The object of the invention is also a forming device of the type comprising a press equipped with two platens between which is interposed a mould for the shaping of a component by superplastic forming, notably a component in titanium or titanium alloy, in aluminium or aluminium alloy, or in any material exhibiting superplastic properties, characterised in that the mould is a mould as defined above.

According to another characteristic of this device, a heating block, preferably made of ceramic, is interposed between each press platen and the mould.

The object of the invention is also a process for forming a component, of the type in which said component is shaped by the superplastic forming in a mould of a plate made of a material capable of undergoing superplastic deformation, notably titanium or titanium alloy, aluminium or aluminium alloy, or any material exhibiting superplastic properties, characterised in that the plate is placed in a mould as defined above.

According to other characteristics of this process:

- a barrier is formed between at least a part of the contact surfaces of the mould and the component being moulded;
- the barrier is formed by coating with boron nitride, at least partially, the contact surfaces of the mould and the component being moulded, before the plate is placed in the mould; and
- the barrier is formed by injecting an inert gas, notably helium or argon, between the contact surfaces of the mould and the component being moulded.

The object of the invention is also a component, notably made of titanium or titanium alloy, aluminium or aluminium alloy, or any material exhibiting superplastic properties, characterised in that it is obtained by a process as defined above.

BRIEF DESCRIPTION OF THE DRAWINGS

The invention will be better understood by reading the following description which is given purely by way of example and made with reference to the figures in which.

DETAILED DESCRIPTION OF THE INVENTION

Figure 1:
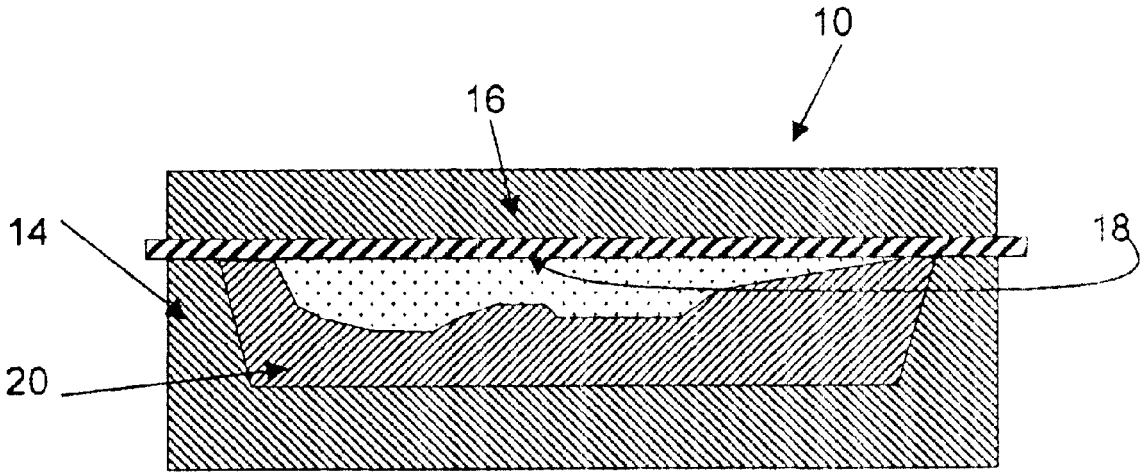
FIG. 1 is a sectional view of a mould according to the invention.
Figure 2:
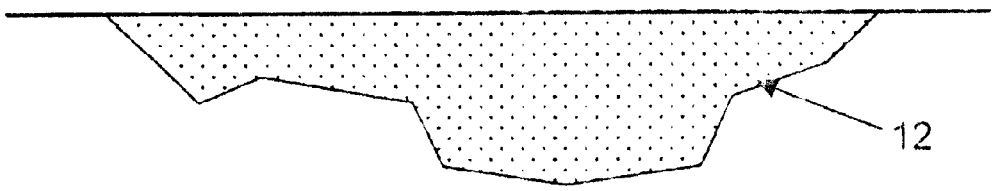
FIG. 2 is a diagrammatic view of a component obtained by the process according to the invention.

FIG. 1 illustrates a mould according to the invention, designated by the general reference 10. This mould is designed to shape a component 12, such as that illustrated in FIG. 2, by superplastic forming.

The component 12 is for example made of titanium or a titanium alloy such as TA6V. The component could be made in other materials capable of undergoing superplastic deformation, for example aluminium.

The mould 10 illustrated in the example in FIG. 1 includes a base 14 and a cover 16 between which a plate 18 in a material capable of undergoing superplastic deformation is intended to be interposed. The base 14 is fitted with an insert 20 delineating a moulding surface designed to be in contact with the component being moulded. As a variant, the moulding surface may be incorporated directly into the base 14.

According to the invention, the mould 10 includes at least one part designed to be in contact with the component being moulded, made from sintered vitreous silica. The parts of the mould in sintered vitreous silica may thus include the base 14, the insert 20 and/or the cover 16.

Sintered vitreous silica, the use of which in the field of the invention has hitherto been deprecated by the person skilled in the art—notably by reason of its thermal insulating properties which are in principle incompatible with heating of the mould—is found to present numerous advantages in the invention, notable among which are the following.

Sintered vitreous silica exhibits practically no sensitivity to uneven temperature distribution. For this reason, there is no necessity to calculate the shape of the mould which is a requirement in the case of conventional metal moulds.

Furthermore, sintered vitreous silica is composed of grains of silica bound together by partial fusion during the sintering process. The grains of silica in this sintered structure are highly resistant to separation, unlike the grains of silica in a refractory concrete (ceramic) structure.

In addition, the structure of the sintered silica, which does not include any binder, is composed of a highly pure vitreous silica phase which does not pose a risk of contaminating the component being shaped by superplastic forming in the mould, unlike the situation observed in the case of a refractory concrete in which the binder tends to contaminate the moulded component.

Finally, the quantity of energy required to bring the mould or the part of the mould made of sintered vitreous silica to the temperature required for superplastic moulding is relatively small compared with the energy required in the case of a conventional metal mould. Once the mould or part of the mould has reached the required temperature, the sintered vitreous silica presents a calorific inertia making it possible to advantageously limit the temperature variations of the mould during successive moulding cycles.

Figures 3, 4, 5:
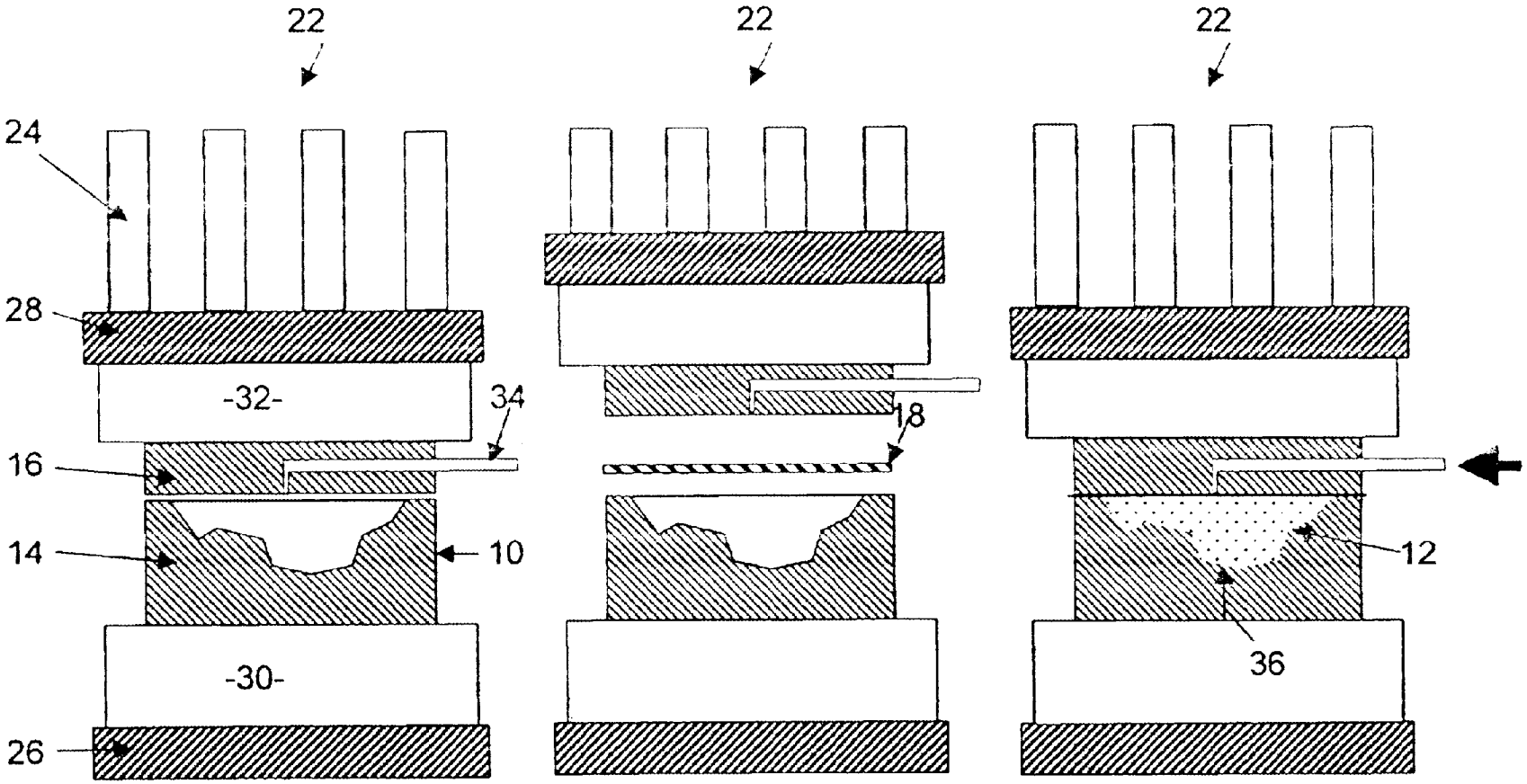
FIGS. 3 to 5 are diagrammatic views of a forming device according to the invention.

The mould 10 illustrated in FIG. 1 is designed to be placed in a forming device 22 such as that illustrated in FIGS. 3 to 5. In these figures, the insert 20 is not shown. The forming device 22 includes a press 24 equipped with two platens, lower 26 and upper 28, between which is interposed the mould 10. A lower heating block 30 is interposed between the lower press platen 26 and the base 14 of the mould. An upper heating block 32 is interposed between the upper press platen 28 and the cover 16 of the mould. These heating blocks 30, 32, of conventional type, are preferably made of ceramic.

In the example illustrated in FIGS. 3 to 5, the forming device 22 includes conventional means 34 of injecting an inert gas such as helium or argon under pressure between the cover 16 and the plate 18. This gas under pressure is designed to deform the plate 18 so as to press it against the forming surface of the base 14.

In order to bring the plate 18 to conditions suitable for superplastic forming, the mould 10 is heated by heat transfer from the heating blocks 30, 32 to the base 14 and the cover 16.

To mould the plate 18, the latter is placed into the open mould 10 as illustrated in FIG. 4, between the base 14 and the cover 16. The mould 10 is then closed, as illustrated in FIG. 1, to clamp the plate 18 between the base 14 and the cover 16. The plate 18 thus forms a seal between the base 14 and the cover 16. The heat from the heated mould 10 is transferred to the plate to raise it to a temperature suitable for superplastic forming. When the desired temperature conditions are reached, inert gas is injected under pressure into the mould to deform the plate 18, as illustrated in FIG. 5.

After forming, the component is removed from the mould 10 in accordance with conventional demoulding practice.

In order to avoid the formation of undesirable oxides at the surface of the moulded component, notably oxides of titanium, and diffusion of these oxides into the mould, a barrier is preferably formed between at least part of the contact surfaces of the mould and the component being moulded.

Such a barrier is formed for example by coating with boron nitride, at least partially, the contact surfaces of the mould and the component being moulded, before the plate 18 is placed in the mould. Where appropriate, the boron nitride coating is applied to the plate only or to the mould only. The boron nitride coating is formed on the plate for example by spraying.

The barrier may also be formed by injecting an inert gas, notably helium or argon, between the contact surfaces of the mould and the component being moulded. To this end, the forming device 22 includes means 36 (shown diagrammatically by an arrow in FIG. 5) for injecting this inert gas between the base 14 and the plate 18, i.e. in contact with the surface of the plate opposite that on which the gas pressure intended to deform the plate 18 is applied.

The gas injection means 36 include for example means of diffusing the gas through at least part of the sintered vitreous silica mould, thereby utilising the porosity of this material to advantage, or through holes in the mould conveying the gas to the surface of the mould intended to be in contact with the moulded component.

The pressure of the gas injected between the base 14 and the plate 18 is adjusted so as not to impede the deformation of the plate against the forming surface of the base. The gas injected between the cover 16 and the plate 18 supplies the energy required to deform the plate 18 and also forms a barrier in the same way as the gas injected between the base 14 and the plate 18.

Of course, the boron nitride coating and the gas barrier can be used in combination. Among the advantages of the invention, it will be noted that it permits the shaping of a component by superplastic forming by means of a mould, fabricated at least partially from vitreous silica, resistant to wear (no separation of silica grains) and thermal shocks. The mould according to the invention thus makes it possible to obtain a component presenting a highly satisfactory surface finish.

What is claimed is:

1. A mold for the shaping of a component by superplastic forming, the mold including at least one part adapted to contact component during forming, and the part consisting essentially of sintered vitreous silica.

2. The mold of claim 1, wherein the mold includes an insert and the insert comprises the part.

3. The mold of claim 1, wherein the mold comprises a contact surface and a barrier adapted to separate, during forming, at least a portion of the contact surface and the compnent.

4. The mold of claim 3, wherein the barrier includes a coating comprising boron nitride.

5. The mold of claim 3, wherein the barrier includes an injector adapted to inject inert gas at the contact surface.

6. An insert for a mold used in shaping a component by superplastic forming, the insert comprising a molding surface adapted to contact the component during forming and comprising sintered viteous silica.

7. A forming device comprising a press equipped with a plurality of platens between which is interposed a mold for the shaping of a component (12) by superplastic forming, the mold including at least one part adapted to contact the component during forming, and the part consisting essentially of sintered vitreous silica.

8. The forming device of claim 7, wherein a heating block is interposed between at least one platen and the mold.

* * * * *